US006715853B2

(12) United States Patent
Berkoben et al.

(10) Patent No.: US 6,715,853 B2
(45) **Date of Patent: *Apr. 6, 2004**

(54) SYSTEM AND METHOD FOR HIGH QUALITY BANK CHECK IMPRINTATION DURING HIGH VELOCITY PASSAGE OF BANK CHECKS

(75) Inventors: Kenneth Richard Berkoben, Plymouth, MI (US); William Donald Chappell, Royal Oak, MI (US); William Lawrence Kozlowski, Novi, MI (US); Carl Raymond Lohrmann, Canton, MI (US)

(73) Assignee: Unisys Corporation, Blue Bell, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/179,234

(22) Filed: Oct. 26, 1998

(65) Prior Publication Data

US 2002/0118233 A1 Aug. 29, 2002

Related U.S. Application Data

(60) Provisional application No. 60/063,077, filed on Oct. 23, 1997.

(51) Int. Cl.[7] ..... B41J 29/393

(52) U.S. Cl. ..... 347/19; 347/14

(58) Field of Search ..... 347/14, 16, 19, 347/13, 42; 235/3

(56) References Cited

U.S. PATENT DOCUMENTS

| | | | | | |
|---|---|---|---|---|---|
| 3,949,363 | A | * | 4/1976 | Holm | 382/140 |
| 4,595,948 | A | * | 6/1986 | Itoh et al. | 347/43 |
| 4,675,696 | A | * | 6/1987 | Suzuki | 347/19 |
| 4,698,642 | A | * | 10/1987 | Gamblin | 347/42 |
| 5,828,387 | A | * | 10/1998 | Wataya et al. | 347/42 |
| 6,164,745 | A | * | 12/2000 | Nagoshi et al. | 347/15 |
| 6,164,749 | A | * | 12/2000 | Williams | 347/19 |

* cited by examiner

*Primary Examiner*—Thinh Nguyen
*Assistant Examiner*—Julian D. Huffman
(74) *Attorney, Agent, or Firm*—Alfred W. Kozak; Mark T. Starr; Lise A. Rode

(57) ABSTRACT

A printer housing assembly provides dual in-line cartridges separated by a pre-set distance. Drive belts are used to pass documents such as checks at a high rate of speed past the nozzles of the dual cartridges. A delayed firing mechanism is provided between the two cartridges so that each cartridge will print exactly the same marking on the same spot of each document as it passes by. Further enhancements and contrast quality can also be developed by use of multiple cartridges more than just two cartridges which are placed in a specialized phased relationship to develop "dot-on-dot" printing of the same target by each individual cartridge.

4 Claims, 4 Drawing Sheets

Document Printing
Document Printing CONTRAST IMPROVED

SYSTEM AND METHOD FOR HIGH QUALITY BANK CHECK IMPRINTATION DURING HIGH VELOCITY PASSAGE OF BANK CHECKS

CROSS-REFERENCES TO RELATED APPLICATIONS

This is a continuation of provisional filing U.S. Ser. No. 60/063,077, filed Oct. 23, 1997 and claims priority therefrom.

FIELD OF THE INVENTION

This system and method involves document printing with ink jet equipment with respect to high speed document processing.

BACKGROUND OF THE INVENTION

One of the major problems involved in document processing relates to high-speed printing on documents which pass by ink jet printing devices at very high-speeds. For example, this occurs in the transport of paper documents at speeds of 150 inches per second, such as functions in the Unisys Corporation's Unisys NDP 1150 document processing machine and other similar systems. A single cartridge acting alone could be made able to print an endorsement statement, or marking on each document as it passes by the print head. However, these printouts generally will have a most unacceptable degree of contrast. As a result, such single cartridge printing systems very often provide poor markings or endorsement on documents which pass by at these very high speeds. It has long been hoped that some system and method could be developed to provide a more reliable definite and higher contrast implementation on each document as it passes at the very high speeds, but heretofore this problem has never been cleanly addressed.

Accordingly, it is an object of the present invention to address the problem of poorly printed out contrast characters and numbers having minimal contrast which constitute endorsements on various documents, such as checks which pass at high speed past the printing head.

The present system and method provides for a dual cartridge ink jet system which allows a much higher and more readable contrast level and is able to achieve a near-letter quality printing level even though the documents pass at very high speeds past the print head.

SUMMARY OF THE INVENTION

The present system and method involves a user-friendly document-endorsing system using dual ink jet cartridges for high speed printing, often at paper speeds of up to 150 inches per second. In order to overcome the problem of poor print-out quality at these high speeds of document motion and transfer, each one of the two dual cartridges is arranged to print an identical pattern on the same target area of a document as it passes each respective print head.

Two adjacent and like ink jet cartridges are mounted in a Unisys NDP 1150 check processing/endorsing is machine. The two cartridges are separated by a distance "S"which in this case, is set at 1.5 inches. The document being printed upon is presented for movement by guiding the document between two flat drive belts which advance the document, such as a check, for example, at a rate of 150 inches per second past the print head surface of each of the cartridges. A document guide spaces a document at approximately 0.050 inches, (less the document thickness), from the print head's array plate. This spacing will be made to vary during the printing process, depending upon the document condition and thickness.

As the document or check moves past the multiple ink spray jet heads, the firing of the jets is phased and synchronized so that after the first jet has placed its marking on the document, then after a subsequent delay, the second jet spray head will place the exact same marking on the exact same spot or target of the document.

In order to overcome any mechanical tolerances or misaligned target points, the firing synchronization and direction is adjustable by service personnel to adjust the timing between the respective cartridge firings until the print patterns produced by the two cartridges are effectively co-incident and overlie each other precisely on the same target area during a test run on a test document. Software is often used to vary the timing between the respective cartridge firings. However, other electronic means may also be utilized to set this delay between the firing of the two ink jet cartridges.

DESCRIPTION OF THE PREFERRED EMBODIMENT

The present system and method involves a user-friendly document endorsing or printing system capable of clear and highly contrasted printing on documents operating at a paper speed of 150 inches or more per second. A typical cartridge 13 is indicated as an OEM cartridge in FIG. 1.

Figure 1:
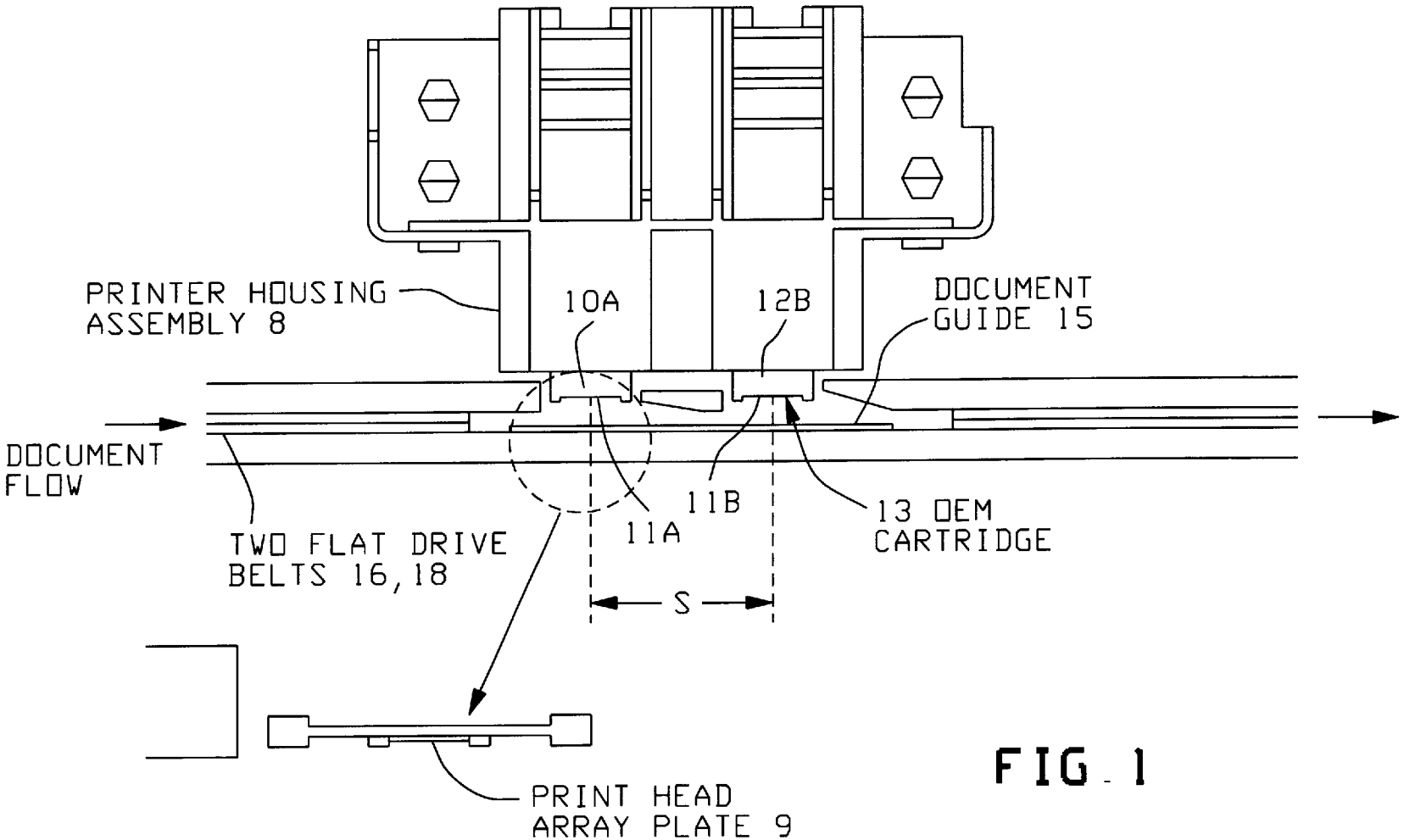
FIG. 1 is a drawing showing the placement of two identical ink jet cartridges spaced next to each other in order to fire ink jet markings upon a moving document.

Referring to FIG. 1, there is seen a fixed printer housing assembly 8, which holds two separated like-type ink jet cartridges designated 10A and 12B. The ink jet cartridge 10A has an outflow orifice 11A, while the ink jet cartridge 12B has a central outflow orifice 11B. Two flat drive belts designated 16 and 18 are used to grasp a document 20 and move it in the direction shown by the arrow (left to right) so that the document first passes the orifice 11A of cartridge 10A, after which it passes the orifice 11B of cartridge 12B. The cartridge orifices are separated by a pre-set distance "S".

A print head array plate 9 is placed opposite each of the jet orifices to support the document as it passes the jet orifice. A document guide 15 is shown which guides the document past each of the jet orifices.

Figure 2:
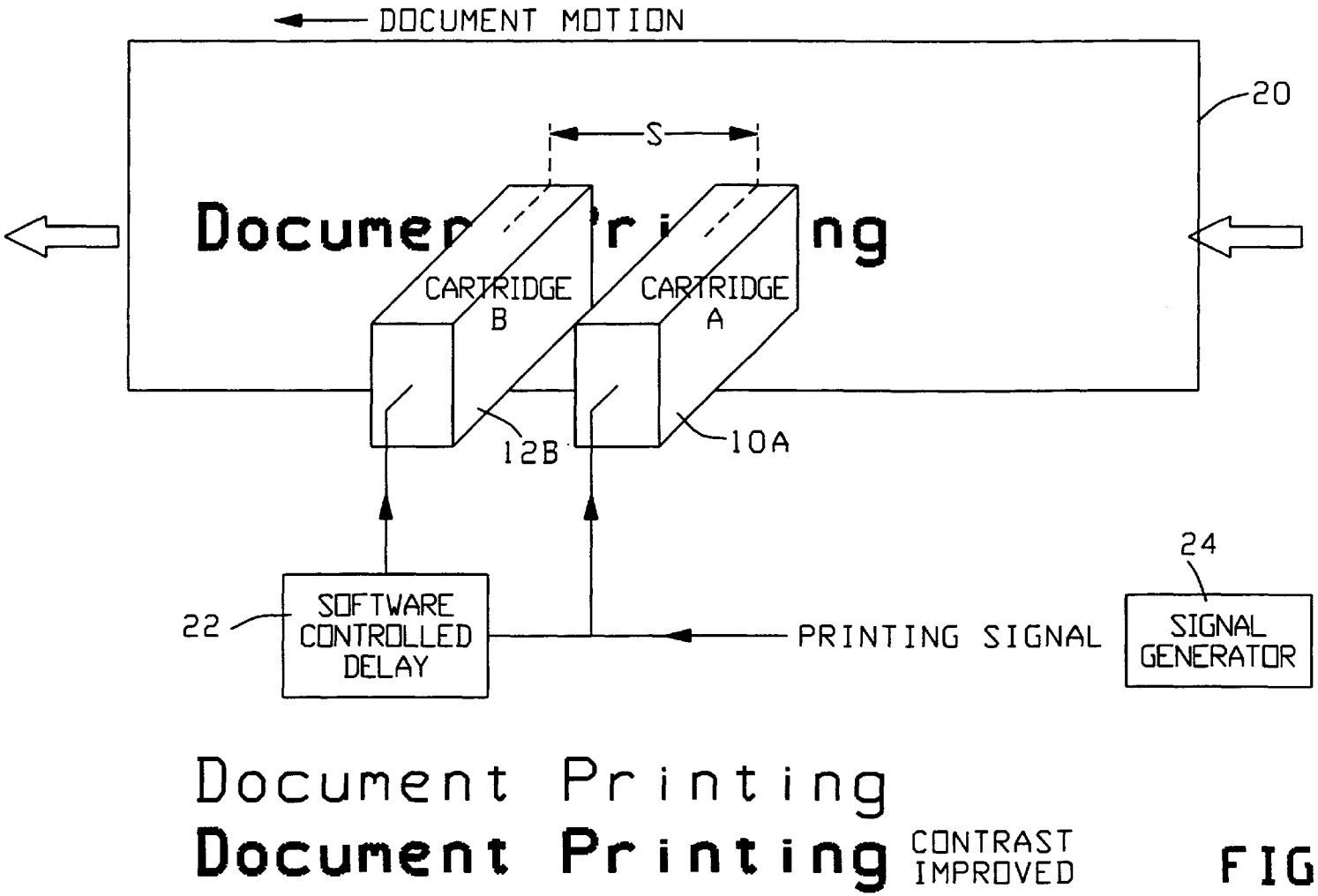
FIG. 2 is a schematic drawing of two cartridges offset from each other by a pre-set distance in order that their jet orifices (nozzles) may fire in a delayed fashion one after another, to make a mark on the very same target in the very same fashion, and whereby the delay time is controlled by a software operation.

FIG. 2 is a schematic drawing showing the motion of a document 20 going past cartridge 10A and thence past cartridge 12B whereby the cartridge 10A is the first firing jet cartridge, and after an optimally set programmed delay, the cartridge 12B will fire the exact same marking on the exact same target location of the document that was just printed upon by the first cartridge 10A.

A software-controlled delay unit 22 is connected to initiate the firing of the first cartridge 10A then after a pre-set delay, it will set the firing of cartridge 12B. This is done as the result of an output printing signal which is fed to the software-controlled delay unit 22 from signal generator 24. The signal generator 24 operates as a function of the velocity "V" relating to the speed of document flow.

The lower portion of FIG. 2 shows that at the proper phase delay, the contrast on the lower portion of FIG. 2 shows how the contrast and readability is improved when the proper phase-delay between the firing of orifices has been properly selected.

As one particular example of the system function, the documents are bank checks. Document motion is at a fixed 150 inches per second in the horizontal direction. The printing signal is in the form of a dot raster with the printing information for one vertical column at a time. The rate of column printing is 9 KiloHertz which produces 60 dots per inch horizontal density on the document. Cartridge A and B are spaced at 1.59 inches in the horizontal direction. This means the software-controlled delay will be approximately 10.6 milliseconds [(1.59 in.)/(150 in/sec)] but the exact delay value is determined using the hereinafter described phasing process to insure optimum printing quality.

Figure 3:
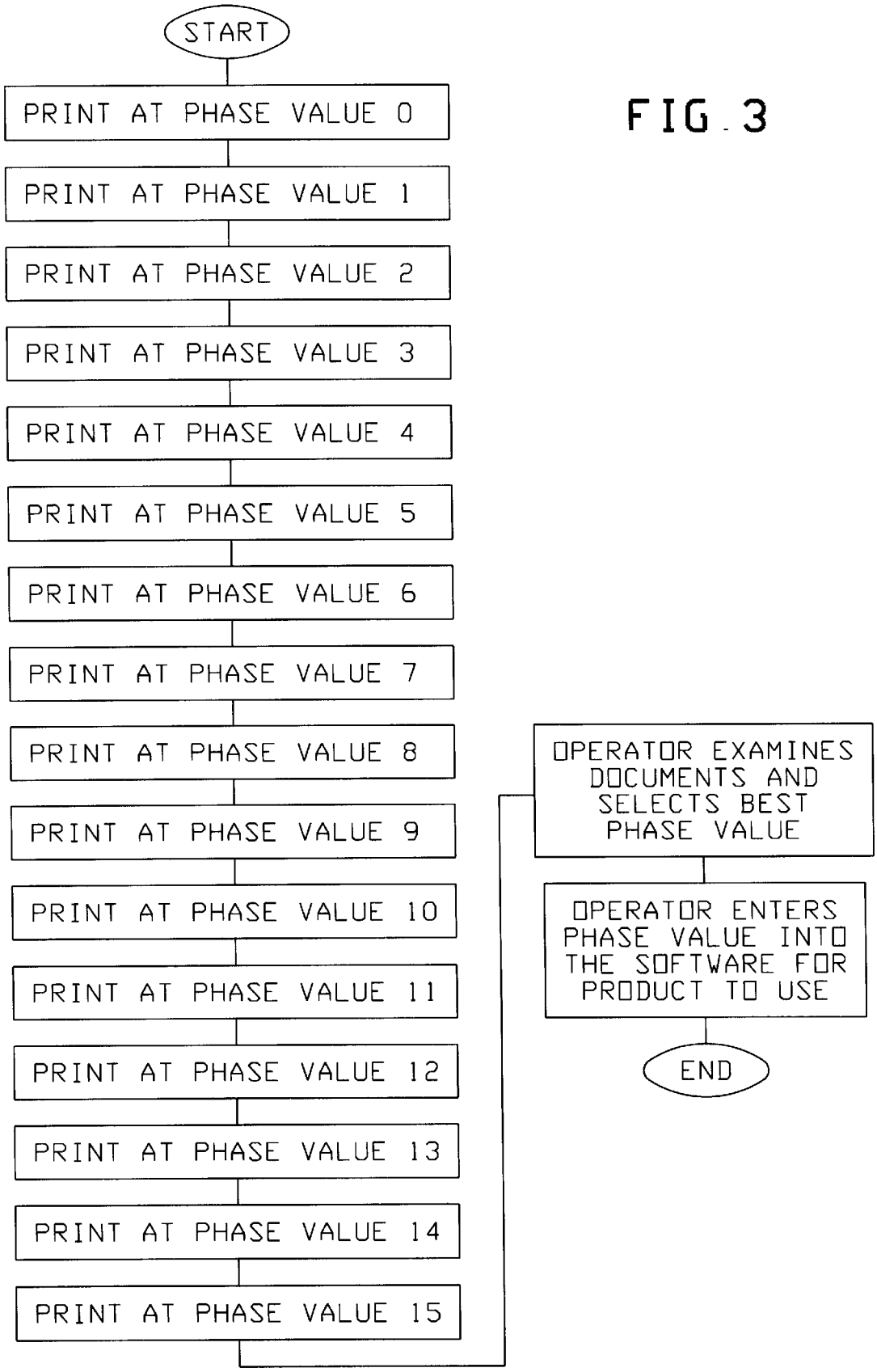
FIG. 3 is a flow chart drawing illustrating various phase-delay values between the firing of the first and second jets in order to determine the optimum delay time between the jets at any given document speed.

FIG. 3 is a test program used by the operator to indicate how the optimum phase value is tested for and subsequently selected. As seen in FIG. 3, the machine is tested first for a phase value of "0", then for a new phase value of "1", then for a new phase value "2", etc., until a print-out at the phase value of 15. Each of the phase values shown in FIG. 3 may be actual increments of 0.1 milliseconds delay.

Figure 4:
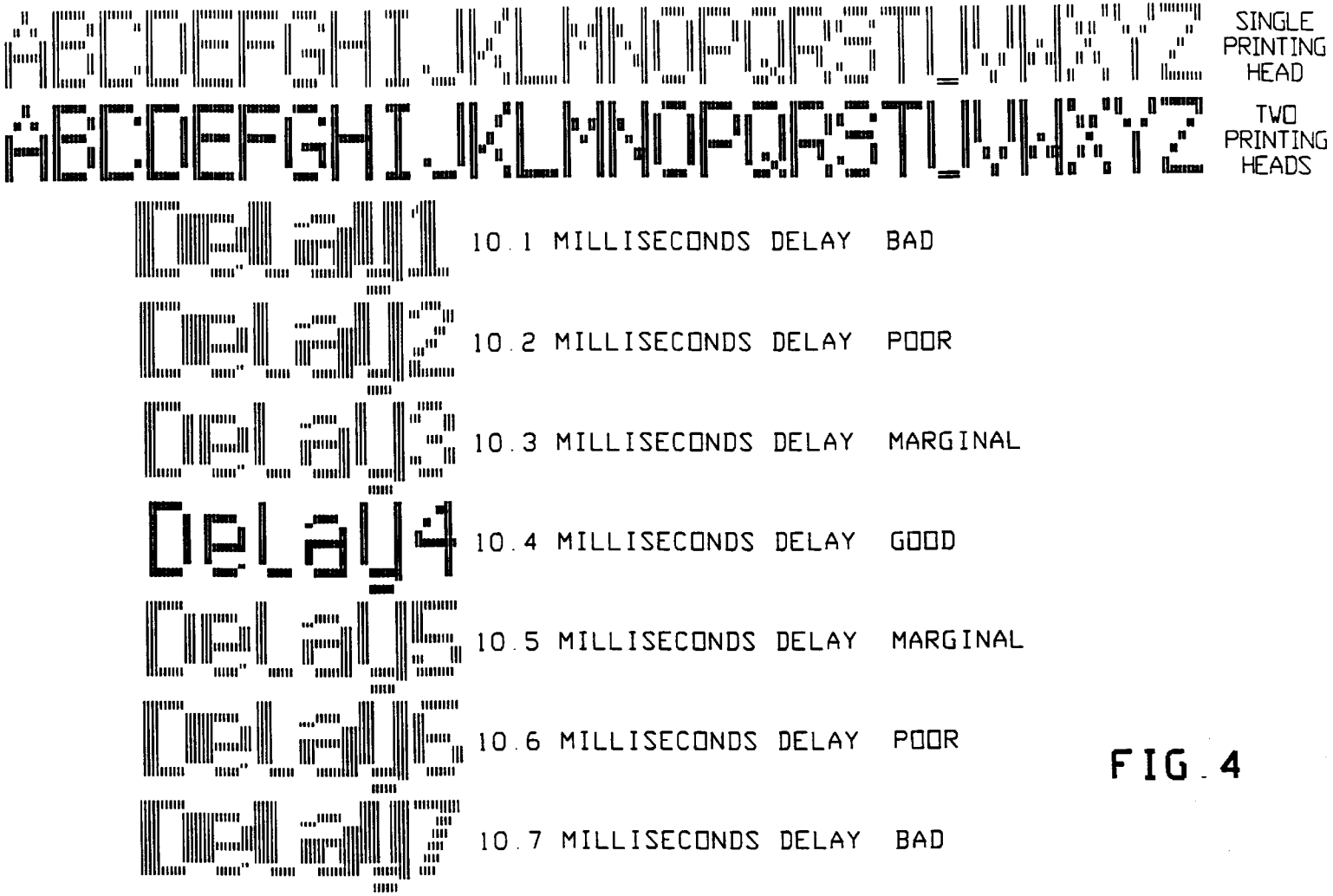
FIG. 4 is a print-out illustration of a phasing system as tested in FIG. 3, whereby observation of a series of different phase delays will indicate which phase delay is the optimum phase delay to generate the highest contrast and clearest print-out for the system in order to set the system at that level for a particular type of document print operation.

Then as seen in FIG. 4, the operator examines each printout of the documents at each individual delay period and he can then select the best phase value to use subsequently thereafter for any particular type of document that is being run through the machine. The operator enters the appropriate phase value into the software unit 22 of FIG. 2, for the product to operate at that particular phase value for the particular type of documents that were tested during that test run. FIG. 4 is an illustration of examples of various printouts at particularly given phase delays when the separate distance between the print head orifices is approximately 1.5 inches. As seen in FIG. 4, the first phase delay of 10.1 milliseconds provides a bad print-out. The second delay of 10.2 milliseconds provides a rather poor print-out. The third delay of 10.3 milliseconds provides a marginal print-out. The fourth delay of 10.4 milliseconds is found to provide a very good print-out. Then subsequently, the 10.5, 10.6 and 10.7 millisecond phase delays go through a sequence of marginal, poor, and bad print-outs.

As a result of this, the operator can select the 10.4 millisecond delay for the particular documents involved and set the software-controlled delay unit 22 to operate at the 10.4 millisecond delay. At the top of FIG. 4, there is seen a typical print-out of a "single" print head which, at high speeds, comes out in a relatively dim contrast value, while with the "dual" print heads, a much darker, readable and higher contrast value is provided for the printout.

The OEM ink jet cartridges used here measure approximately 3.5 inches×2.5 inches×0.75 of an inch, and they contain both their own ink supply and the ink jet printing array. They are easily and quickly replaceable by a machine operator without the complications associated with ink jets having large ink reservoirs, pumps, piping and plumbing. This concept of integrated efficient cartridges is used in Unisys NDP 1825 document processors.

The systems described herein are produceable at a very low initial cost and require very little maintenance.

As previously mentioned, the presentation of the document to be moved past the print head and printed upon, is achieved by trapping the document between two flat drive belts. These belts pass the document at 150 inches per second in front of the print head surface of the cartridges. A document guide 15 spaces the document at 0.050 inches (less the document thickness), from the print head array plate 9. This spacing will vary during the printing process depending upon the document condition and thickness. Also, various thickness guides can be substituted or made thinner or thicker depending on the document thickness.

There are certain even faster and higher throughput document sorters, such as the Unisys NDP 1825 that moves checks and other documents at the speed of 300 inches per second. In order to achieve satisfactory printing endorsement quality in this and higher speeds, it will be seen that additional cartridges would have to be ganged together in order to form a "multiple cartridge" system which involve possibly 3 or 4 cartridges, each of which would be spaced-apart at a given distance and each of which would be fired by software at various phase delay times in order to hit the same target with the exact same marking.

The housing 8 (FIG. 1) that positions the two cartridges 10A and 12B registers the locating assembly on the cartridges in order to minimize vertical and horizontal variations of the basic nozzle positions. This ensures that "dot-on-dot" printing variations can be easily be corrected by use of the phasing or synchronization feature. The housing 8 also supports two miniature printed circuit boards with spring-loaded contact pins that provide the electrical interface to the two print heads which provide for the timing and firing of the nozzles. The housing assembly has three vertical detented positions and can be manually moved to provide a wide range of print locations on the document. Thus, the system can be set up so that any desired area of the documents passing by can be printed upon.

In order to guarantee that every nozzle (orifice) of each cartridge (in the situation of multiple cartridges) places its ejected droplet of ink in a precise location on the moving document, that is to say "dot-on-dot", the firing of the nozzles is synchronized together with the document motion as was indicated in FIGS. 3 and 4. Here, there was enabled the overcoming of any build-up in mechanical tolerances by an adjustable synchronization available to service personnel who could use software to vary the timing between the respective cartridge firings until the print patterns produced by the multiple cartridges would overlay each other precisely as verified by the test documents, as seen in FIG. 4.

In the case, of FIG. 2 of the two cartridges 10A and 12B, these cartridges receive separate printing information in a databurst, which coincides with the column print rate. The data for the "downstream" cartridge 12B is delayed in a software buffer to compensate for the separation distance "S" which is normally set at 1.5 inches. The column print rate is not generally precise enough by itself so that there is provided a second control which is used on the downstream cartridge 12B in order to provide a more precise delay factor which may be increased by a factor of 4 times.

As previously noted in FIGS. 3 and 4, the synchronization is accomplished by printing a number of test runs on a number of "throwaway" test documents to indicate the pattern of printing at a number of different incremented delay values. These values are chosen to encompass all of the possible tolerance values and it operates like a "test sweep" of values. After the best print result is determined, then the appropriate delay is set from this value, and it may be noted that this value need not be adjusted again until a major document-handling component is replaced. The cartridges themselves are precise enough to not require any adjustment even when the cartridges are replaced.

Described herein has been a system and method for high-speed printing endorsement of documents being endorsed and imprinted by an ink jet spray array. The ink jet spray array may involve an assembly of two offset-spaced ink jet cartridges or may involve multiple numbers 3 or 4, etc., of ink jet cartridges which have pre-set spatial distances from each other. Documents such as checks, can be moved at high speeds anywhere in the range from 150 inches per second, up to 300 inches per second and more, depending upon the number of ink jet cartridges involved in order to provide a readable, clear high-contrast printout on the documents being processed.

Before a given set of documents of a given thickness and size are used to run through the printing system, a test run is initiated with a variable number of phase-delay times between the multiple ink cartridges in order to select the phase delay time which provides the highest contrast and most clear printout on the documents being processed. Once the optimum phase delay time has been set, then a high-speed run of the given type of documents can be effectuated with very desirable print-out results having high contrast and easy readability. While other variations of the described system and method may be implemented, the invention is defined according to the following claims.

What is claimed is:

1. A bank check processing method for aligning stationary dual print cartridges with ink jet nozzles, designated as upstream and downstream cartridges separated at a distance "S", in an ink jet check printer for high-speed print-marking replicatable by each of said cartridges on bypassing documents passing at high speed in one direction only via print signals and a firing time set by a control means where check document velocity "V" is a measurable item, including the steps of:

(a0) feeding bank checks at a high speed measured velocity V through a check-guiding channel to run past the nozzles of said upstream and downstream cartridges said velocity V operating in the range of 150–300 inches per second in the transport of said bank checks through said check-quiding channel;

(a) establishing a stationary cartridge housing with a pair of like cartridge receiving slots for quick plug-in reception of cartridges to fix both nozzle positions at a prescribed separation distance S;

(b) providing associated control means for synchronizing the ink firing of each of said cartridges with print signals according to the high speed check passing velocity V of bank checks bypassing said cartridges;

(c) compensating for said separation S, via print control means where the print signals to said downstream cartridge are routed via delay control means;

(d) fine-tuning of the delay between the firing time between said first and second cartridges by use of said delay control means to adjust for machine tolerances;

(e) selecting test-bank checks for high speed running past said nozzles of said first and second cartridges while feeding identical test print signals to said control means, and while varying said control means across a sequence of various delay values to develop a test pattern of said print-marking on said test-bank checks;

(f) varying the delay time value between the nozzle firings between said upstream and downstream cartridges over a programmed sequence of values in order to yield test pattern bank check printings that enable the delay selection value having the most legible registration of said print-markings on said bank checks.

2. A system for enabling dual in-line stationary ink jet cartridges, designated as an upstream cartridge and a downstream cartridge, and held in relationship to bank checks being moved thereby in one direction only at high speeds, to be phasedly fired so that each said downstream cartridge replicates and prints the very same markings on the very same spot that was printed by said upstream cartridge on each passing bank check, comprising:

(ao) channel guiding and transport means for transporting bank checks at high speed past said upstream and downstream cartridges said bank checks of nominal length of 6 inches being transported in the range of 19 checks per second up to 33 checks per second past said upstream and downstream cartridges;

(a) means for mounting said upstream and downstream ink jet cartridges at a fixed separation distance "S" apart wherein each said cartridge includes a nozzle orifice aligned to imprint markings upon each bank check bypassing at high speeds;

(b) means to sense the speed "V" of said bank checks bypassing said orifices;

(c) control means responsive to said speed "V" and said fixed distance "S" to initiate a phase delayed firing of said downstream cartridge with identical signals after the firing of said upstream cartridge so that said downstream cartridge replicates the markings made by said upstream cartridge on each bypassing bank check, said control means including:

(c1) software means to vary said phase delayed firing of said downstream cartridge over a range of time delays to observe which time delay provides the most accurate overlay of marking replication by said downstream cartridge over said markings of said upstream cartridge, wherein said means to vary said phase-delayed firing includes:

(c1a) software program means which is responsive to said transport velocity "V" and said separation distance "S" and includes:

(i) means to vary said time period of said phased-delay firing in small increments;

(c2) means to select and utilize that particular time delay which indicates the closest registration between said replicated printed markings deposited by said downstream and upstream cartridges on said bank checks passing said nozzle orifices.

3. The system of claim 2 wherein said markings include:

(i) printed characters, symbols or specially designated markings used on bank checks.

4. A check processing system for imprinting bank markings on bank checks being channeled to pass at high speeds past orifice nozzles of an upstream and downstream ink jet print cartridge comprising:

(a) means to feed and channel a stream of bank checks at a high speed transport velocity "V" directly past the orifice nozzles of said upstream and downstream ink jet print cartridge said transport velocity "V" operating at a speed level of 150 to 300 inches per second, such that bank checks of the normal 6 inches in length will be transported at the level of 19 to 33 checks per second during the imprintation process;

(b) means for mounting said upstream and downstream ink jet cartridges at a fixed separation distance "S" apart wherein each said cartridge includes a nozzle orifice aligned to imprint markings upon each bypassing bank check;

(c) means to sense the speed "V" of said bank checks bypassing said orifices;

(d) control means responsive to said speed "V" and said fixed distance "S" to initiate a phase delayed firing of said downstream cartridge with identical signals after the firing of said upstream cartridge so that said downstream cartridge replicates the markings made by said upstream cartridge on each bypassing bank check, said control means including:

(d1) software means to vary said phase delayed firing of said downstream cartridge over a range of time delays to observe which time delay provides the most accurate overlay of replicative markings by said downstream cartridge over said markings of said upstream cartridge, wherein said means to vary said phase-delayed firing includes:

(d1a) software program means which is responsive to said transport velocity "V" and said separate distance "S" and includes:

(i) means to vary said time period of said phased-delay firing in small increments;

(d2) means to select and utilize that particular time delay which indicates the closest registration between said replicated printed markings deposited by said downstream and which correlate to said markings made by said upstream cartridge on each passing bank check.

* * * * *